United States Patent [19]

Chepurnoi et al.

[11] 3,952,813

[45] Apr. 27, 1976

[54] PERCUSSIVE DEVICE FOR DRIVING HOLES IN SOIL

[76] Inventors: Nikolai Prokhorovich Chepurnoi, 107, ulitsa Televizionnaya, 11, kv. 20; Alexandr Dmitrievich Kostylev, 91, ulitsa Derzhavina, 19, kv. 44; Konstantin Stepanovich Gurkov, ulitsa Derzhavina, 19, kv. 13; Konstantin Konstantinovich Tupitsyn, ulitsa Krylova, 3, kv. 37; Sergei Konstantinovich Tupitsyn, ulitsa Zorge, 123, kv. 31; Nikolai Grigorievich Nazarov, ulitsa Gogolya, 3, kv. 10; Vladimir Dmitrievich Plavskikh, ulitsa Kamenskaya, 84v, kv. 33; Khaim Berkovich Tkach, ulitsa Gogolya, 17, kv. 49; Evgeny Nikolaevich Cherednikov, ulitsa Lenina, 32, kv. 6, all of Novosibirsk; Alexandr Nisovich Galbinshtein, Leninsky prospekt, 89, kv. 214, Moscow; Mikhail Vladimirovich Borshtein, Pirogovskaya, 5, kv. 78, Odessa; Andron Trofimovich Karavaev, ulitsa Pervomaiskaya, 118, kv. 19, Novosibirisk; Valery Anatolievich Menzorov, ulitsa Sorevnovania, 40, Novosibirisk; Alexei Mikhailovich Makarov, Vostochny poselok, 8a, kv. 16, Novosibirisk, all of U.S.S.R.

[22] Filed: Feb. 7, 1975

[21] Appl. No.: 548,137

[52] U.S. Cl. ..... 173/91; 173/127; 175/19

[51] Int. Cl.[2] ..... E21B 1/00; E21B 11/02

[58] Field of Search ..... 173/91, 126, 128, 127, 173/131, 139; 175/19

[56] References Cited

UNITED STATES PATENTS

| | | | |
|---|---|---|---|
| 1,005,770 | 10/1911 | Clark | 173/128 |
| 1,222,663 | 4/1917 | Penney | 173/139 |
| 2,720,802 | 10/1955 | Geller | 173/131 |
| 3,651,874 | 3/1972 | Sudnishnikov et al. | 173/91 |
| 3,756,328 | 9/1973 | Sudnishnikov et al. | 173/91 |
| 3,763,939 | 10/1973 | Sudnishnikov et al. | 173/91 |

*Primary Examiner*—James A. Leppink
*Attorney, Agent, or Firm*—Haseltine, Lake & Waters

[57] ABSTRACT

A percussive device comprising a housing with a pointed front end and a hammer piston accommodated in the housing to form a front working chamber therewith. The hammer piston is provided, in the rear portion thereof, with a cavity in permanent communication with a source of compressed air, the cavity serving as a rear working chamber. An airdistribution mechanism includes a tube mounted in the housing within the hammer piston cavity so that it is conjugated with the walls of the cavity, the piston having air passages therein positioned in such a manner that, during the reciprocation, the tube alternately communicates the front working chamber, via these passages, with either the rear working chamber or ambient atmosphere. The device is characterized by the provision of means for controlling the direction of the hole driving constituted by a construction wherein the hammer piston has its center of gravity offset with respect to the longitudinal axis of the housing, the hammer piston hits the housing at a location on a line extending through the center of gravity of the hammer piston, the hammer piston being positively rotatable relative to the housing.

12 Claims, 16 Drawing Figures

PERCUSSIVE DEVICE FOR DRIVING HOLES IN SOIL

The present invention relates to the field of construction and in particular, for driving holes in the soil for laying-in underground communications without excavation.

Known in the art is a percussive device for driving holes in soil comprising a cylindrical housing with a pointed front end having an inner space accommodating a hammer piston which forms a front working chamber in combination with the housing, the hammer piston being adapted to reciprocate under the action of compressed air and having a cavity in permanent communication with a source of compressed air which serves as a rear working chamber, an air-distribution mechanism including a tube mounted in the housing within the cavity of the hammer piston so that the tube is conjugated with the walls of the cavity, and air passages terminating in the cavity of the hammer piston which are arranged in the hammer piston body in such a manner that, during the reciprocation of the hammer piston, the tube alternately communicates the front working chamber with either the rear working chamber or ambient atmosphere at regular intervals through said passages, and means for controlling the direction of the hole driving.

The means for controlling the direction of the hole driving comprises a pair of bushes located between the housing and the hammer piston. The bushes are rotatable relative to each other, and their inner surfaces are arranged eccentrically relative to the outer surfaces thereof. The direction of movement of the device is controlled by shifting the point at which a blow is imparted with respect to the longitudinal axis of the device (by rotating the bushes relative to each other).

The disadvantage of such known device consists in the fact that the arrangement of the bushes between the housing and hammer piston results in a small volume of the front chamber and small diameter of the hammer piston, and hence in light weight thereof. Therefore, the device has a low impact power.

In addition, the construction of the known device does not permit location of the position of the hammer piston with respect to the longitudinal axis of the device, and hence, determination of the direction of movement of the device. The known device is also deficient in that it cannot be returned to the initial position after driving a blind hole or in an emergency situation, where an immovible obstruction occurs in the path of movement of the device.

It is an object of the invention to provide a percussive device for driving holes in the soil which has an increased impact power.

Another object of the invention is to provide a device which is reversible, while having an increased impact power.

These and other objects are accomplished by the provision of a percussive device for driving holes in the soil, comprising a cylindrical housing with a pointed front end accomodating a hammer piston forming a front working chamber in combination with the housing, the hammer piston reciprocating under the action of compressed air and having a cavity in permanent communication with a compressed air source serving as a rear working chamber, an air-distribution mechanism including a tube mounted in the housing within the cavity of the hammer piston in such a manner that the tube is conjugated with the walls of the cavity, air passages terminating in the cavity of the hammer piston and arranged in the hammer piston body in such a manner that, during the reciprocating of the hammer piston, the tube alternately communicates the front working chamber, via and passages, with either the rear working chamber or ambient at regular intervals, and means for controlling the direction of the hole driving, wherein, according to the invention, said means for controlling direction of the hold driving is constituted by the construction wherein the center of gravity of the hammer piston is offset with respect to the longitudinal axis, the point at which the hammer piston hits against the housing being located an a line substantially coinciding with the line extending through the center of gravity of the hammer piston, the hammer piston being positively rotatable relative to the housing.

In order to ensure the positive rotation of the hammer piston, the tube is preferably connected thereto by means of a splined connection and is operatively connected to a motor shaft.

The rotation of the hammer piston may also be effected by using a shaft operatively connected to a motor shaft, the hammer piston being provided with an auxiliary cavity having a bush therein so that said shaft extends within the bush and is connected thereto by means of a splined connection.

The above-described construction of the device enables the rotation of the hammer piston and ensures the formation of rectilinear holes with the center of gravity of the hammer piston and the point of application of impact on the housing being offset.

It is also advantageous to ensure the offset location of the center of gravity of the hammer piston with respect to the housing axis by providing an external groove arranged eccentrically with respect to the longitudinal axis of the housing.

The center of gravity of the hammer piston may also be offset with respect to the housing axis by providing the hammer piston with an additional mass of a material whose specific gravity is greater than that of the material of the hammer piston, the additional mass being fixed to the hammer eccentrically with respect to the longitudinal axis of the housing.

Such structural features enable the formation of curvilinear holes with a non-rotating hammer piston using the device according to the invention.

The tube of the air-distribution mechanism is preferably provided with an opening in the peripheral wall and with projections on the outer periphery of this wall, as well as with a rotatable shutter adapted to close said opening during the rotation of the hammer piston in one direction and to open said opeing during the rotation of the hammer piston in the opposite direction for admitting compressed air into the front working chamber and for reversing the device.

It is also advantageous that the tube of the air-distribution mechanism be provided with openings in the peripheral wall thereof and with an axially movable shutter mounted within the tube, the shutter having external projections received in said openings of the tube and internal projections, and the shaft being provided with a thread cooperating with the internal projections of the shutter in such a manner that, during the rotation of the shaft in one direction, the shutter closes the openings of the tube, and during the rotation of the shaft in the opposite direction, the shutter opens these openings to admit compressed air to the front working chamber to reverse the device.

The above structural features enable the device to be reversed.

In order to ensure the rotation of the hammer piston, it is advantageous to provide in the tube a pneumatic motor and a slide valve with a drive, the drive controlling the direction of rotation of the motor shaft and stoppage thereof by rotating the slide valve, the motor shaft being operatively connected to the shaft for rotating the hammer piston so that the device can be made more compact.

The drive accommodated in the tube is also preferably connected to the slide valve by means of a splined connection and provided with an axially spring-loaded piston having, in the peripheral wall thereof, a circular slot, the walls of the slot being shaped in such a manner as to form projections and recesses, the projections and recesses at one side of the slot being circumferentially offset with respect to similar projections and recesses at the opposite side of the slot, the tube preferably provided with a pin fixed thereto having its free end received in the circular slot to cooperate with the projections and recesses of the slot upon switching over the compressed air supply, whereby the piston and slide valve are rotated to be sequentially fixed in three different positions corresponding to the motor shaft rotation in two opposite direction and stoppage thereof so that the movement of the device for driving rectilinear and curvilinear holes, as well as the reverse thereof can be remotely controlled.

It is advantageous to fix to the shaft in the tube a disk having a notch on the peripheral surface and to provide a passage in the tube having one end thereof terminating on the inner peripheral surface of the tube in the zone of location of the disk, the other end of the passage being connected to an indicator, whereby, when the notch and the passage are in register (as a result of rotation of the disk), the indicator indicates the position of the hammer piston under the action of compressed air so that the position of the hammer piston is remotely monitored and controlled in a desired manner for driving a curvilinear hold in a desired direction.

This invention provides a device having an elevated impact power, enabling the formation of holes in any desired direction and ensuring reverse drive of the device.

The invention will now be described in detail with reference to specific embodiments thereof illustrated in the accompanying drawings, in which.

Figure 3:
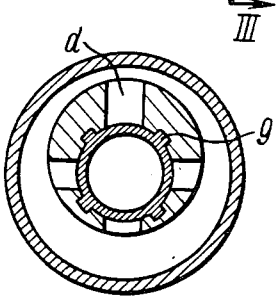
FIG. 3 is a sectional view taken along line III—III in FIG. 1.

The percussive device for driving holes in the soil comprises a housing 1 with a pointed front end (FIGS. 1–3) accommodating a hammer piston 2 which forms a front working chamber *a* in combination with the housing 1. The piston 2 has a cavity *b* in permanent communication with a compressed air source (not shown) via a flexible hose 3, the cavity defining a rear working chamber *c*. For effecting reciprocation of the hammer piston, thee is provided an air-distribution mechanism 4 including a tube 5 mounted in the housing within the cavity *b* of the hammer piston so that the outer periphery of the tube is conjugated with the walls of this cavity. Air passages *d* are provided in the hammer piston terminating in the cavity of the hammer piston and arranged such that, during the reciprocation of the hammer piston, the tube 5 alternately communicate, via said passages, the front working chamber *a* with either the rear working chamber *c* or ambient atmosphere at regular intervals.

The hammer piston is rotated by means of a rotating mechanism 6 having a motor 7 operatively connected to the hammer piston via a transmission 8 to rotate the tube 5 which imparts the rotary motion to the hammer piston by means of a splined connection 9.

The center of gravity of the hammer piston is offset with respect to the longitudinal axis of the housing due to the provision of an eccentric groove *e* in the hammer piston. The front point 10 of the hammer piston 2 which strikes against the housing 1 is also eccentrically located on a line extending through the center of gravity of the hammer piston.

The device operates in the following manner.

Under the action of compressed air in the rear chamber *c*, the hammer piston 2 moves towards the front portion of the housing 1. When in its foremost position, the hammer piston imparts an impact to the housing 1. In this position of the hammer piston, compressed air is admitted through the passages *d* from the rear chamber *c* into the front chamber *a*. Since the effective area of the hammer piston is larger at the side of the front chamber *a* than its effective area at the side of the rear chamber *c*, the piston starts moving in the opposite direction. During this movement, the tube 5 closes the passages *d* thereby interrupting the admission of compressed air into the front chamber *a*. The hammer piston continues its movement due to the expansion of the air in the front chamber *a* until the passages *d* are displaced beyond the trailing edges of the tube 5, and the front chamber *a* is placed to communication with ambient atmosphere. In this position the air is exhausted from the front chamber *a* into the atmosphere. Then the cycle is repeated.

In driving a rectilinear hole, the device operates with the rotating mechanism 6 in the operative position. Thus, the motor 7 effects, via the transmission 8, rotation of the tube 5 thereby imparting the rotary motion to hammer piston via the splined connection. The hammer piston rotates and impact blows to the housing 1 uniformly along a circumference of a radius *r*. Where it is desired to drive a curvilinear hole, the hammer piston is rotated by means of the rotaring mechanism 6 is deactivated. As a result, during the operation of the device, the impact blows are imparted at one and the same point of the housing so that the device is deviated to drive a hole in the desired direction.

Figure 2:
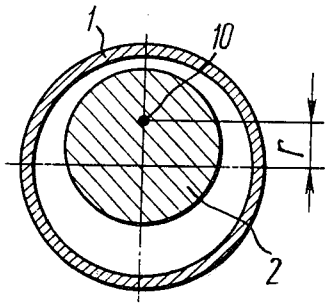
FIG. 2 is a sectional view taken along line II—II in FIG. 1.

Thus, when it is desired to drive a hole deviating downwards, the hammer piston is positioned in such a manner that the point of the impact application of blow should be located above the longitudinal axis of the housing O—O as shown in FIG. 2. Due to the offset location of the center of gravity of the hammering mass, a force moment is developed to deviate the device downwards.

Figure 1:
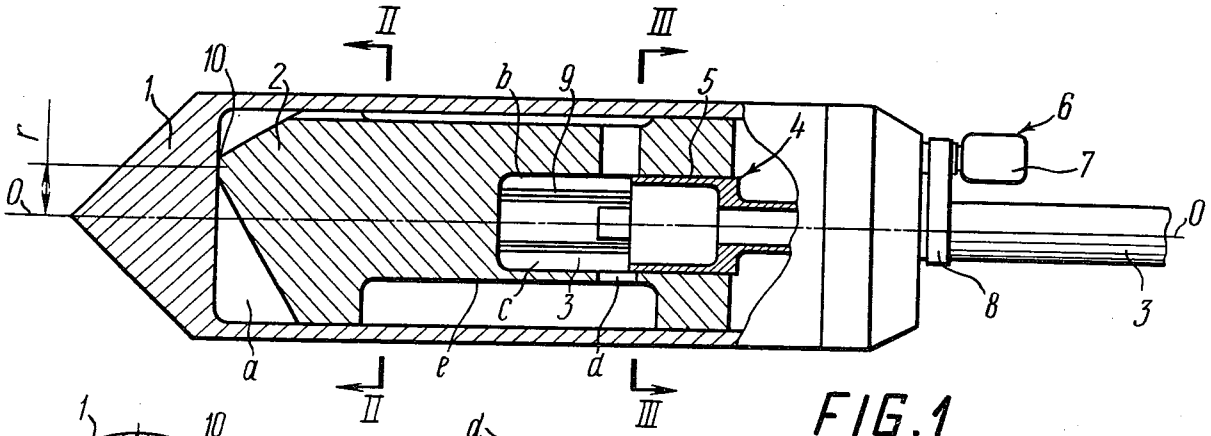
FIG. 1 shows a longitudinal section of a percussive device for driving holes in soil according to the invention.

In the device shown in FIG. 1, the members of the air-distribution mechanism are also used for rotating the hammer piston. This is ensured by the use of the rotatable tube. In distribution devices without a tube, e.g. in those having a valve-type distribution, the above-described arrangement cannot be employed.

Figure 4:
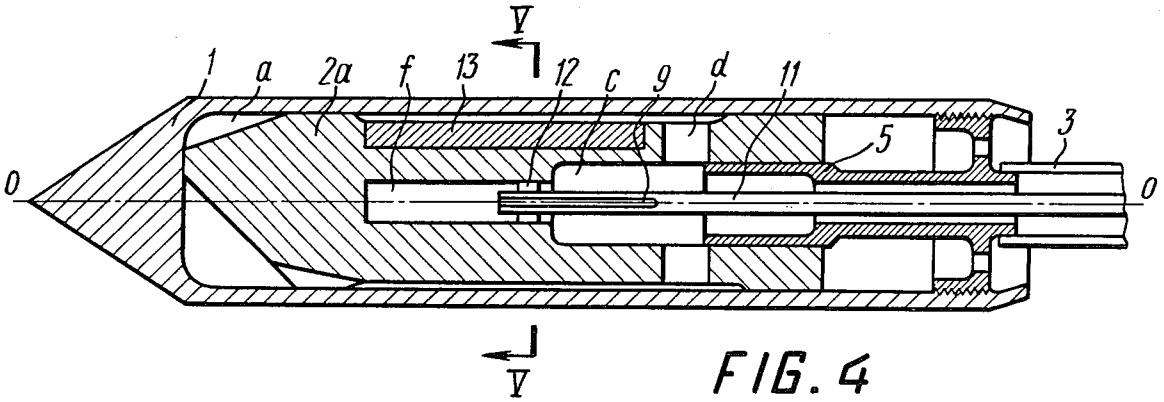
FIG. 4 shows a longitudinal section of a percussive device for driving holes in soil according to the invention, wherein the hammer piston is provided with an additional mass of a material whose specific gravity is greater than that of the material of the hammer piston.
Figure 5:
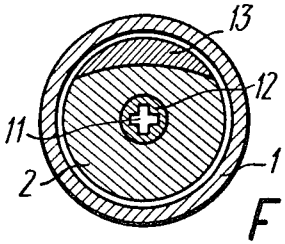
FIG. 5 is a sectional view taken along line IV—IV in FIG. 4.

FIGS. 4 and 5 show another embodiment of the device. This embodiment permits control of the movement of the device with different types of air-distribution mechanisms.

This is accomplished in that the device is provided with a shaft 11 operatively connected to a motor (not shown), and the hammer piston 2*a* has an auxiliary cavity *f* in which there is fixed a bush 12, said shaft extending within this bush and being connected thereto by means of a splined connection 9.

In this embodiment, the center of gravity of the hammer piston is offset with respect to the axis O—O by providing the hammer piston with an additional mass 13 of a material whose specific gravity is greater than that of the material of the hammer piston, the additional mass being located eccentrically with respect to the axis O—O within the hammer piston.

The device operates in the following manner.

During the formation of a rectilinear hole, the hammer piston 2*a* reciprocates to impact blows at the front portion of the housing similarly to the device described above with reference to FIGS. 1–3. The shaft 11 is uniformly rotated. Due to the operative connection of shaft-bush-hammer piston, the hammer piston is also uniformly rotated respectively.

To explain the operation of the device, FIGS. 4, 5 show one of the possible embodiments of the air-distribution mechanism, which, in this case, is similar to that shown in FIG. 1, wherein the air-distribution mechanism includes a tube, i.e. the principle of operation of the air-distribution mechanism remains the same as in the device shown in FIG. 1.

Where it is desired a drive a curvilinear hole, the shaft 11, and hence the hammer piston 2, is fixed in a desired position as described above with reference to the operation of the device shown in FIG. 1. Due to the presence of the additional mass of a greater specific gravity eccentrically located within the hammer piston 2*a* and rigidly fixed thereto, the center of gravity of the hammer piston is offset with respect to the axis O—O of the housing. Thus, during reciprocation, the hammer piston will impart eccentric impact blows at the housing at one and same point thereof, whereby the device will be turned in a desired direction to drive a curvilinear hole.

Figure 6:
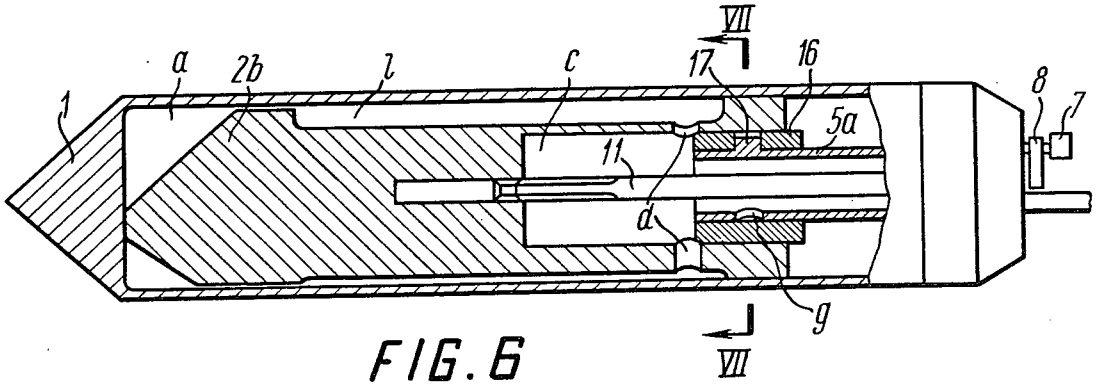
FIG. 6 shows the device with a reverse mechanism.
Figure 7:
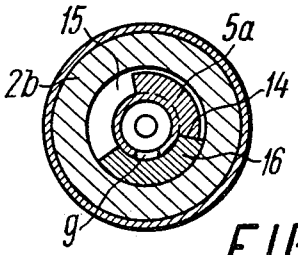
FIG. 7 is a sectional view taken along line VII—VII in FIG. 6.

FIGS. 6, 7 show a device with provision for drive. The tube 5*a* is provided with an opening *g* in the peripheral wall thereof and with projections 14 and 15 on the outer periphery thereof, as well as with a rotatable shutter 16 adapted to close the opening *g* during the rotation of the hammer piston 2*b* in the course of the forward movement of the device and to open this opening for an anticipated admittance of compressed air to the front working chamber *a* during reverse travel of the device. The projections 14 and 15 restrict the angular displacement of the shutter 16, while a projection 17 prevents shutter 16 from displacing along the axis O—O of the housing.

The control of the forward/backward movement of the device is effected in the following manner. During the formation of a hole, the hammer piston 2*b* is caused to rotate in the counter-clockwise direction by the rotating mechanism 6. Under the action of friction forces between the hammer piston 2*b* and the shutter 16, the latter is caused to rotate in the counter-clockwise direction until it is arrested against the projection 14 to close the peripheral opening *g* of the tube 5*a*. Under the action of compressed air in the rear chamber *c*, the hammer piston 2*b* is displaced towards the front portion of the housing 1. When in its foremost position, the hammer piston imparts a blow to the housing 1. In this position of the hammer piston, compressed air is admitted from the rear chamber *c*, via the passages *d*, to the front chamber *a*. Since the effective area of the hammer piston is larger at the side of the front chamber *a* than that at the side of the rear chamber *c*, the hammer piston starts moving in the opposite direction. During this movement, the tube 5*a* closes the passages *d* thereby interrupting the admission of compressed air to the front chamber *a*. The hammer piston continues its movement due to the expansion of the air in the front chamber *a* until the passages *d* are displaced beyond the trailing edges of the tube 5*a*, and the front chamber *a* is placed into communication with ambient atmosphere. In this postion, the air is exhaust from the front chamber *a* into the atmosphere. Then the cycle is repeated.

In order to reverse the device, the hammer piston 2*a* is rotated in the opposite direction (in the clockwise direction) so that it causes the rotation of the shutter 16 in the same direction due to the presence of friction forces until the shutter is arrested against the projection 15 to open the opening *g*. In this case, during the forward movement of the hammer piston, compressed air is admitted to the front chamber *a* with an anticipation, when the passages *d* are in register with the opening *g* of the tube. Therefore, the movement of the hammer piston 2*b* towards the front chamber *a* is interrupted, and no blow will be imparted to the housing 1. Since the effective area of the hammer piston is larger at the side of the front working chamber *a* than its effective area at the side of the rear working chamber *c*, the hammer piston starts moving in the opposite direction to reverse the device by imparting a blow at the rear portion of the housing.

Figure 8:
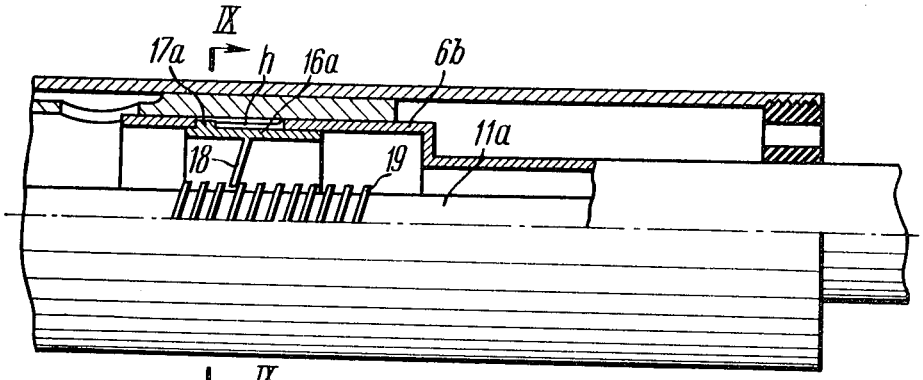
FIG. 8 shows the device illlustrated in FIG. 6 with another embodiment of the reverse mechanism.
Figure 9:
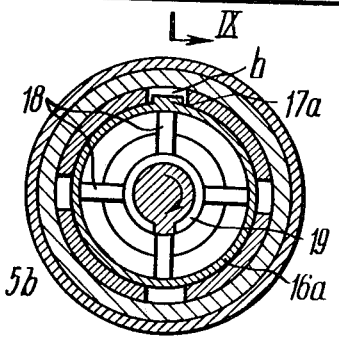
FIG. 9 is a sectional view taken along line IX—IX in FIG. 8.

FIGS. 8, 9 show another embodiment of the reverse mechanism. As differed from the first embodiment of the reverse mechanism shown in FIGS. 6, 7, the shutter 16*a* opens the openings of the tube 5*b* during its movement axially of the housing, the shaft 11*a* controlling the displacement of the shutter 16*a*.

The shutter 16*a* is mounted within the tube 5*b*. It is provided with external projections 17*a* received in peripheral openings *h* of the tube 5*b*. The lateral walls of the opening *h* restrict the axial displacement of the shutter 16*a*. The shutter 16*a* is provided with internal projections 18, and the shaft 11*a* has a thread 19, the projections 18 cooperating with the thread 19 during the operation of the reverse mechanism. The projections 18 are made of an elastic material.

The reverse drive is effected in the following manner. During the rotation of the shaft 11*a*, the turns of its thread 19 cooperate with the elastic projections 18 of the shutter 16*a* to cause an axial displacement of the shutter. The amount of such displacement depends on the length of the opening *h* and the dimensions of the projections 18. As to the direction of this displacement (to the right or to the left in FIG. 8), it depends on the rotational direction of the shaft 11*a* and the direction of its thread 19. Thus, with the rotational direction of the shaft 11*a* as shown in FIG. 9, the shutter will be displaced forwards (to the left in FIG. 8). With the shaft rotating in the opposite direction, the shutter 16*a* will be displaced backwards (to the right in FIG. 8) until the projection 18 is arrested against the lateral wall of the opening *h* of the tube 5*b*. Thus, the lefthand end face of the shutter 16*a* opens the supply of compressed air through the opening *h* of the tube 5*b*, and the device will operate in the reverse mode.

After the displacement of the shutter 16*a* until the arrested position in one or other direction, the shaft 11*a* will not stop rotating, and the internal elastic projection 18 of the shutter 16*a* will be deflected to slide over the turns of the thread 19 of the shaft 11*a*.

The device is switched over from one mode to the other by changing the direction of rotation of the drive shaft 11*a* operatively connected to the reverse mechanism.

Figure 10:
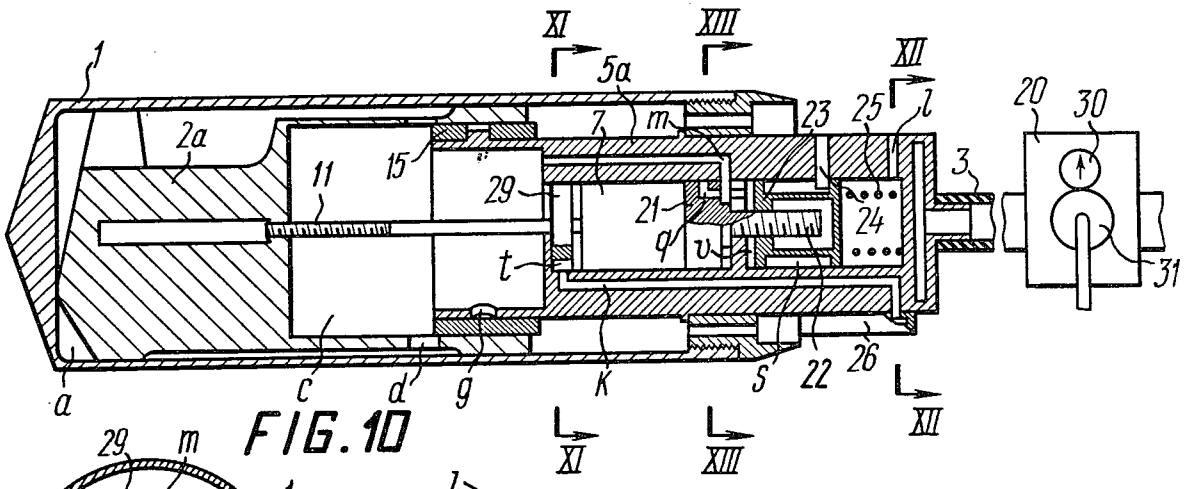
FIG. 10 is a device of FIG. 6 with a remote control mechanism.
Figure 12:
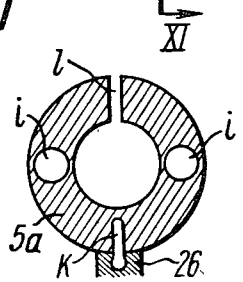
FIG. 12 is a sectional view taken along line XII—XII in FIG. 10.
Figure 11:
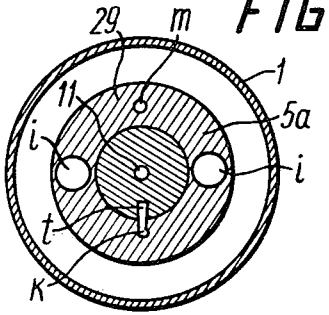
FIG. 11 is a sectional view taken along line XI—XI in FIG. 10.

FIGS. 10–12 show the device with a remote control which is effected from a control board 20. This device differs from that shown in FIG. 6 in that its tube 5*a* accommodates a pneumatic motor 7 for rotataing the hammer piston 2*b* and a slide valve 21 with a drive which controls the rotational direction of the shaft of the motor 7 and stoppage thereof by rotating the slide valve.

The shaft of the motor 7 is operatively connected to the splined shaft 11 for rotating the hammer piston 2*b*, and the slide valve 21 is connected, by means of splines 22, to a piston 23 cooperating with a pin 24, and to a spring 25

The tube 5*a* is provided with passages *i* (FIG. 11) for admitting compressed air to the rear chamber *c*; passages *k* for admitting compressed air to an acoustic indicator 26; passages *l* (FIG. 12) for communicating the cavity of the piston 23 with ambient atmosphere; passages *m* (FIG. 11) for admitting compressed air to the slide valve 21; passages *n* and *p* (FIGS. 13, 14 and 15) to communicate the motor 7 with an air-supply line (not shown) via the flexible hose 3.

The slide valve 21 has a passage *q* for selectively communicating the passages *n* and *p* of the motor with the air-supply line. The stem of the slide valve 21 has splines 22 cooperating with the piston 23.

The piston 23 is provided with a peripheral circular slot *s* having walls shaped in such a manner as to form projections 27, 27*a* and recesses 28, 28*a*, the projections 27 and recesses 28 at one side of the slot *s* being circumferentially offset with respect to the corresponding projections 27*a* and recesses 28*a* at the opposite side of the slot. The slot *a* receives pin 24 fixed in the tube 5*a*. Upon switching over the compressed air in the air-supply line and upon the correspondingly displacement of the piston, the pin 24 cooperates with the projections and recesses to sequentially rotate the piston and the slide valve to fix them in three different positions corresponding to the rotation of the shaft of the motor 7 in two opposite directions and stoppage thereof. Therefore, the piston 23 having the circular slot *s* connected to the slide valve 21 by means of the splines 22, as well as the pin 24 and the spring 25 constitute the drive of the slide valve 21.

The tube 5*a* accommodates a disk 29 fixed to the shaft 11 and having a notch *t* on the peripheral surface thereof, and the tube 5*a* is also provided with a passage *k* having one end terminating on the inner peripheral surface of the tube in the zone of location of the disk, the other end of the passage being connected to the indicator 26. The shaft 11 is connected to the hammer piston 2*b* in such a manner that the center of gravity of the hammer piston and the notch *t* of the disk 29 lie in one and the same plane. When the notch *t* is in register with the passage *k* of the tube, the compressed air is admitted from the rear chamber *c* via the passage *k* to the indicator 26. This indicates that the center of gravity of the hammer piston 2*b* is located in a predetermined position.

The control board 20 is provided with a mode indicator 30 and a two-position selector valve 31 controlling the supply of the device with compressed air.

The device operates in the following manner.

Upon opening the valve 31, compressed air is admitted to the rear chamber *c*, via the flexible hose 3 and passages *i* of the tube 5*a*, to displace the hammer piston towards the front portion of the device. Upon opening the passage *d*, the air is admitted to the front chamber *a* of the device, and, due to a difference in the effective areas of the hammer piston at the side of the front and rear chambers, the hammer piston 2*a* is displaced backwards. Thus, upon opening the valve 31, the hammer piston reciprocates in any case. At the same time, compressed air is fed, via the passage *m*, to a passage *v* of the piston 23 to cause its axial displacement. The piston 23 moves to compress the spring 25 (to the right in FIG. 10). Thus, the projection 27 cooperates with the pin 24 to rotate the piston 23 through a predetermined angle. Upon the interrupting the compressed air supply, the piston moves in the opposite direction under the action of the spring 25 (to the left in FIG. 10) and is also rotated through a predetermined angle due to the cooperation with the projection 27*a*. The bevels in the slot *s* are oriented in such a manner that the rotation of the piston 23 during its axial displacement in one or the other direction is effected in a single direction only. Therefore, the piston, during every cycle including the admittance and interruption of the air supply, causes the rotation of the slide valve 21 through a predetermined angle so as to ensure the switching-over of the operating modes of the device in a strictly defined sequence.

At the same time, a slide valve of the mode indicatior 30 of the control board 20 is actuated which operates synchronously with the slide valve 21 of the mode selector valve 31 (two-position valve) and is provided with an indentical piston and spring.

Figure 13:
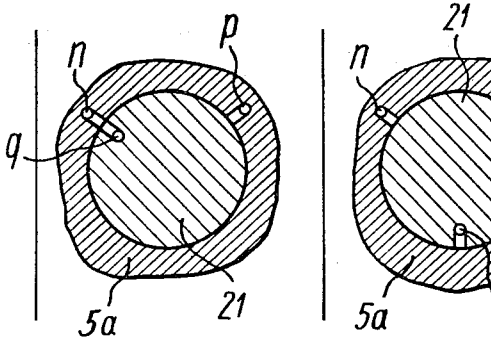
FIG. 13 is a sectional view taken along line XIII—XIII in FIG. 10 (the position of the slide valve 21 during the forward movement of the device along a rectilinear path.
Figure 14:
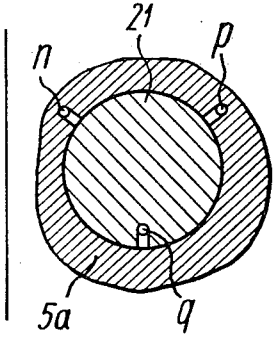
FIG. 14 is similar to FIG. 13, during the forward movement of the device along a curvilinear path.

Upon interrupting the compressed air supply, the slide valve 21 takes a position between the operative positions, and the valve 31 is closed in this position. Upon opening the valve 31, the slide valve 21 is rotated to communicate the passage *n* of the motor with the air-supply line (FIG. 13). The motor rotates the hammer piston, e.g. to the right. The hammer piston, in turn, cooperates with the shutter 16 due to the presence of friction forces to close the opening *g* of the tube 5*a*. The hammer piston is rotated and imparts impact blows to the front portion of the housing. Thus, the device moves forwards along a rectilinear path.

When in register with the passage *k*, the notch *t* of the disk 29 admits the compressed air from the chamber *c*, via the passage *k*, to the acoustic indicator 26 whose signals indicate the position of the center of gravity of the hammer piston. The time intervals between the signals corresponds to one revolution of the hammer piston. Therefore, the valve 31 is closed at the instant when the center of gravity is in the position corresponding to a desired direction of deviation of the device.

Thus, where it is desired to deviate the device downwards (FIG. 10), the center of gravity of the hammer piston should be located at the top. The instant of closing of the valve 31 corresponding to this position of the hammer piston will occur after a lapse of time equal to one-half of the time interval for one revolution of the hammer piston after the acoustic signal. Therefore, upon the closing of the valve after the operation of the device in the forward mode, the hammer piston will have a completely predetermined position of its center of gravity.

Upon subsequent opening of the valve 31, the passages *n* and *p* (FIG. 14) of the motor are closed. The hammer piston only reciprocates to impact blows to one and the same point of the housing thereby resulting in turning of the device in the soil in a predetermined direction. After the device has been deviated through at predetermined angle, the supply of compressed air to the device is interrupted by the valve 31.

Figure 15:
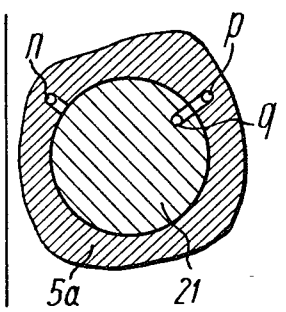
FIG. 15 is, during the reverse of the device.
Figure 16:
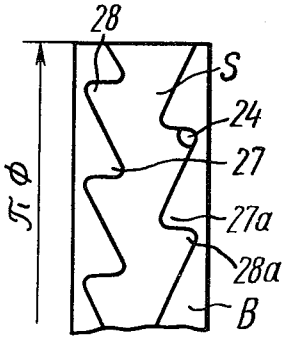
FIG. 16 is a developed view of the piston of the remote control mechanism shown in FIG. 10, on plane of the outer surface.

Upon subsequent opening of the valve 31, the slide valve 21 will admit the air to the passage *p* of the motor 7 (FIG. 15). Thus, the rotational direction of the motor is changed to the opposite one relative to the forward mode of operation of the device, e.g. to the left.

The hammer piston 2*b* rotates in the opposite direction to entrain the shutter 16 which opens the opening *g* of the tube 5*a*. Thus, the compressed air is admitted to the front chamber *a* with an anticipation so that the hammer piston imparts impact blows to the rear portion of the housing as described above to reverse the device.

If it is desired to continue the advance of the device in the forwards direction after a correction of the path has been made, the operation in the reverse mode is effected for a short time period (practically for a few seconds), that is the opening *g* will not have time to be opened in this case.

After the closing and subsequent opening of the valve 31, the device will operate in the forward mode as described above.

Upon every opening of the valve 31, the mode indicator 30 indicates a predetermined mode of operation of the device.

The transmission of the control commands via the air supply line considerably simplifies the operation of the device, while the provision of the mode indicator on the control board facilitates the control of the device and improves the reliability of the hole formation along a predetermined path.

The test conducted with a device according to the invention have shown positive results.

What is claimed is:

1. A percussive device for driving holes in the soil, comprising: a hollow cylindrical housing with a pointed front end; a hammer piston accommodated in said housing for reciprocation under the action of compressed air, said piston having a cavity in permanent communication with a source of compressed air used to reciprocate said hammer piston, said hammer piston being positively rotatable relative to said housing and forming together therewith a front working chamber; an air distribution mechanism including a tube mounted in said housing within the cavity of said hammer piston so as to form a rear working chamber together therewith, said piston having air passages therein positioned so that during the reciprocation of said hammer piston, said tube alternately communicates, via said passages, said front working chamber with said rear working chamber and ambient atmosphere; and means for controlling the direction in which the hole is driven in the soil, said means being consituted by a construction wherein said hammer piston has a center of gravity offset with respect to the longitudinal axis of said housing, said hammer piston having a contact point at which it strikes said housing located on a line substantially extending through the center of gravity of said hammer piston.

2. A device according to claim 1, wherein, in order to ensure the positive rotation of said hammer piston, said tube is connected to said hammer piston by means of a splined connection and is operatively connected to the shaft of a motor.

3. A device according to claim 1, wherein, in order to ensure the positive rotation of said hammer piston, there is provided a drive shaft operatively connected to the shaft of a motor, said hammer piston having an auxiliary cavity in which there is fixed a bush, said shaft extending within said bush and being connected thereto by means of a splined connection.

4. A device according to claim 1, wherein the center of gravity of said hammer piston is offset with respect to the axis of said housing by providing an external groove in said piston eccentrically disposed with respect to the axis of said housing.

5. A device according to claim 1, wherein the center of gravity of said hammer piston is offset with respect to the axis of said housing by providing said hammer piston with an additional mass of a material whose specific gravity is greater than the specific gravity of the material of said hammer piston, said additional mass being fixed to said hammer piston eccentrically with respect to the axis of said housing.

6. A percussive device for driving holes in the soil, comprising: a hollow cylindrical housing having a pointed front end; a hammer piston accommodated in said housing for reciprocation under the action of compressed air, said piston having a cavity in permanent communication with a source of compressed air for reciprocation of said hammer piston, said hammer piston being positively rotatable relative to said housing and forming together therewith a front working chamber; an air-distribution mechanism including a tube mounted in said housing within said cavity of said hammer piston so as to form a rear working chamber together therewith, said piston having air passages during the reciprocation of said hammer piston, said tube alternately communicates said froning chamber, via said passages, with said rear working chamber and ambient atmosphere at regular intervals, and means for controlling the direction in which the hole is driven in the soil, said means being constituted by a construction wherein said hammer piston has a center of gravity offset with respect to the longitudinal axis of said housing, said hammer piston having a contact point at which it strikes said housing located on a line substantially extending through the center of gravity of said hammer piston; said tube of the air-distribution mechanism having an opening in the peripheral wall thereof and including projections on the outer surface of said wall, a rotatable shutter mounted between said projections to close said opening due to friction forces between said shutter and said hammer piston during the rotation of the hammer piston in one direction and to pen said opening of said tube during the rotation of said hammer piston in the opposite direction for admitting compressed air into said front working chamber, whereby the device is reversed.

7. A percussive device for driving holes in the soil, comprising: a hollow cylindrical housing having a pointed front end; a hammer piston accommodated in said housing for reciprocation under the action of compressed air, said housing having a cavity in permanent communication with a source of compressed air for reciprocation of said hammer piston, said hammer piston being positively rotatable relative to said housing and forming together therewith a front working chamber; an air-distribution mechanism including a tube mounted in said housing within said hammer piston so as to from a rear working chamber together therewith, said piston having air passages so that during the reciprocation of said hammer piston, said tube alternately communicates said front working chamber, via said passages, with said rear working chamber and ambient atmosphere at regular intervals; and means for controlling the direction of in which the hole is driven in the soil, said means being constituted by a construction wherein said hammer piston has a center of gravity offset with respect to the longitudinal axis of said housing, said hammer piston having a center point at which it strikes said housing located on a line substantially extending through the center of gravity of said hammer piston; a shaft in said housing connected to said hammer piston for rotating said piston; a motor connected to said shaft for rotating the same and said hammer piston thereby; said tube of said air-distribution mechanism having openings in the peripheral wall thereof, and a shutter disposed within said tube, said shutter being axially movable and having external projections received in said openings of the tube, and internal projections, said shaft having a thread cooperating with said internal projections of said shutter such that during the rotation of said shaft in one direction, said shutter closes the opening of said tube, and during the rotation in the opposite direction, said shutter opens said openings of said tube for admitting compressed air to said front working chamber, whereby the device is reversed.

8. A percussive device for driving holes in the soil, comprising: a hollow cylindrical housing having a pointed front end; a hammer piston accommodated in said housing for reciprocation under the action of compressed air, said piston having a cavity in permanent communication with a source of compressed air for reciprocation of said hammer piston, said hammer piston being positively rotatable relative to said housing and forming together therewith a front working chamber; an air-distribution mechanism including a tube mounted in said housing within the cavity of said hammer piston so as to form a rear working chamber together therewith, said piston having air passages therein positioned so that during the reciprocation of said hammer piston, said tube alternately communicates said front working chamber, via said passages, with said rear working chamber and ambient atmosphere at regular intervals; means for controlling the direction in which the hole is driven in the soil, said means being constituted by a construction wherein said hammer piston has a center of gravity offset with respect to the longitudinal axis of said housing, said hammer piston having a contact point at which it strikes said housing located on a line substantially extending through the center of gravity of said hammer piston; a shaft in said housing connected to said hammer piston for rotating the latter; said tube of said air-distribution mechanism having an opening in the peripheral wall thereof and spaced projections on the outer periphery thereof, a rotatable shutter mounted between said projections to close said opening under the action of friction forces between said shutter and hammer piston during the rotation of the hammer piston in one direction and to open said opening of said tube during the rotation of said hammer piston in the opposite direction for admitting compressed air to said front working chamber, whereby the device is reversed; a pneumatic motor and a slide valve with a drive, said drive controlling the direction of rotation of said motor and stoppage thereof by rotating said slide valve, said motor and slide valve being mounted within said tube; said motor being operatively connected to said shaft to rotate said hammer piston.

9. A device according to claim 8, wherein said drive of the slide valve includes an axially spring loaded piston mounted within said tube, said piston having a peripheral slot with walls shaped to form projections and recesses, said projections and recesses at one side of said slot being circumferentially offset with respect to similar projections and recesses at the other side of said slot, and a pin fixed in said tube having a free end received in said slot to cooperate with said projections and recesses upon switching over the compressed air supply to said motor, whereby said piston and slide valve are rotated to be sequentially fixed in three different positions corresponding to the rotation of said motor in two opposite directions and stoppage thereof.

10. A percussive device for driving holes in the soil. comprising: a hollow cylindrical housing having a pointed front end; a hammer piston accommodated in said housing for reciprocation under the action of compressed air, said piston having a cavity in permanent communication with a source of compressed air for reciprocation of said hammer piston, said hammer piston being positively rotatable relative to said housing and forming together therewith a front working chamber; an air-distribution mechanism including a tube mounted in said housing within the cavity of said hammer piston so as to form together therewith a rear working chamber, said piston having air passages therein positioned so that during the reciprocation of said hammer piston, said tube alternately communicates said front working chamber, via said passages, with said rear working chamber and ambient atmosphere; means for controlling the direction in which the hole is driven in the soil said means being constituted by a construction wherein said hammer piston has center of gravity offset with respect to the longitudinal axis of said housing, said hammer piston having a contact point at which it strikes said housing located on a line substantially extending through the center of gravity of said hammer piston; a shaft in said housing connected to said hammer piston for rotating the latter; said tube of said air-distribution mechanism having an opening in the peripheral wall thereof and spaced projections on the outer periphery thereof, a rotatable shutter mounted between said projections to close said opening under the action of friction forces between said shutter and hammer piston during the rotation of said hammer piston in one direction and to open said opening during the rotation of said hammer piston in the opposite direction for admitting compressed air to said front working chamber, whereby the device is reversed; a pneumatic motor and a slide valve with a drive, said drive controlling the direction of rotation of said motor and stoppage thereof, said motor and slide valve being mounted within said tube; said motor being operatively connected to said shaft for rotating said hammer pisotn; said drive of said slide valve having an axially spring-loaded piston mounted within said tube and spline connected to said slide valve, said piston having a peripheral slot with walls shaped to form projections and recesses, said projections and recesses at one side of said slot being circumferentially offset with respect to similar projections and recesses at the opposite side of said slot, and a pin fixed in said tube having a free end received in said slot to cooperate with said projections and recesses upon switching-over of the compressed air supply to said motor, whereby said piston and slide valve are rotated to be sequentially fixed in three different positions corresponding to the rotation of the shaft of said motor in two opposite directions and stoppage thereof; a disk fixed to said shaft within said tube for indicating the position of said hammer piston, said disk having a notch on the peripheral surface thereof, said tube being provided with a passage having one end terminating at the inner periphery of said tube in the zone of location of said disk, the other end of the passage being connected to said indicator, whereby, when said notch and passage are in register as a result of rotation of said disk, said indicator indicates the position of said hammer piston under the action of compressed air admitted from said rear working chamber.

11. A device according to claim 10 comprising means for effecting positive rotation of said hammer piston comprising a drive motor coupled to said tube to rotate the same, and a splined connection between said tube and said hammer piston.

12. A device according to claim 10 comprising means for effecting positive rotation of said hammer piston comprising a driven drive shaft, said hammer piston having an auxiliary cavity, a bush fixed in said auxiliary cavity, said driven shaft extending within said bush and being spline connected thereto.

* * * * *